US006394020B1

(12) United States Patent
Belyeu

(10) Patent No.: US 6,394,020 B1
(45) Date of Patent: May 28, 2002

(54) TRANSPARENT KAYAK/CANOE HULL

(76) Inventor: Dan B. Belyeu, 3316 Greens Mill Rd., Spring Hill, TN (US) 37174

( * ) Notice: Subject to any disclaimer, the term of this patent is extended or adjusted under 35 U.S.C. 154(b) by 0 days.

(21) Appl. No.: 09/932,017

(22) Filed: Aug. 18, 2001

Related U.S. Application Data

(60) Provisional application No. 60/227,691, filed on Aug. 24, 2000.

(51) Int. Cl.[7] ..... B63B 5/24
(52) U.S. Cl. ..... 114/357; 114/347
(58) Field of Search ..... D12/302; 114/357, 114/347, 66

(56) References Cited

U.S. PATENT DOCUMENTS

| | | | | |
|---|---|---|---|---|
| 4,841,899 A | | 6/1989 | Fleckles | 114/347 |
| 5,000,106 A | | 3/1991 | Rheney | 114/66 |
| D341,565 S | | 11/1993 | Reha | D12/300 |
| D343,380 S | | 1/1994 | Wortham | D12/306 |
| 5,337,692 A | | 8/1994 | Troiani | 114/61 |
| D394,630 S | * | 5/1998 | Lincoln | D12/302 |
| 2001/0001941 A1 | | 5/2001 | Dust | |

FOREIGN PATENT DOCUMENTS

| | | |
|---|---|---|
| FR | 2612447 | 9/1988 |
| FR | 263 3892 | 1/1990 |

OTHER PUBLICATIONS

P. 6 of "Yachting" Magazine, vol. 102, No. 5, Nov. 1957.*

* cited by examiner

*Primary Examiner*—Ed Swinehart

(57) ABSTRACT

A combination canoe/kayak hull unitarily formed from seamless transparent thermoplastic where said thermoplastic is transparent polycarbonate or polycarbonate-acrylic blend. The canoe/kayak hull is molded in a fashion providing for multiple kayak top cap arrangements or canoe gunnel attachments dependent upon the trimming angle of the formed hull. The peripheral edge of the untrimmed hull is formed 90 degrees to the hull sides allowing for multiple trimming heights so as to be used as either a canoe or kayak hull. When hull is trimmed as a kayak, the trim line is on a horizontal plane following the lower edge of the canoe splash guard resulting in the peripheral edge being approximately 90 degrees to the bottom of the hull. When hull is trimmed as a canoe, the trim line is an arc where the ends of the hull are substantially taller than the midship peripheral edge.

1 Claim, 4 Drawing Sheets

TRANSPARENT KAYAK/CANOE HULL

This application claims the benefit of Provisional Patent Application Ser. No. 60/227,691 filed Aug. 24, 2000.

FEDERALLY SPONSORED RESEARCH

Not Applicable

SEQUENCE LISTING OR PROGRAM

Not Applicable

BACKGROUND

1. Field of Invention

This invention relates generally to transparent kayaks and canoes with hulls unitarily formed from transparent thermoplastic sheet in a configuration requiring no internal support, specifically resulting in the following characteristics: extreme impact resistance, flexibility, light weight, optical clarity, and seamless below the waterline.

2. Description of Prior Art

Human powered watercraft, specifically canoes and kayaks, are a popular recreational activity. The use of canoes and kayaks range from casual recreational, hunting, fishing, to death defying white water exploits. The canoe and kayak, both ancient designs, must possess the ability to be agile, strong, impact resistant, and easily transported; light weight.

Having the ability to see beneath the surface of water is a popular recreational activity as demonstrated by the large numbers of persons engaging in snorkeling and scuba diving activities as well as the popularity of glass-bottom tour boats. The common denominator in seeing underwater is providing an air barrier between the eye and the water. In snorkeling and scuba this is accomplished via use of a mask with a plane of glass or plastic separating the eyes from the water via a volume of air. The same principle applies to glass-bottom boats.

Consequently, combining the ability to view underwater while seated in a canoe or kayak is widely desired. Prior art has not yielded a means by which to accomplish both while in a canoe or kayak without undesirable tradeoffs in one or more of, structural integrity, weight, impact resistance, safety, guidance/tracking, and optical clarity.

Various attempts to yield underwater views while paddling have been made. Generally, doing so requires one to use expensive underwater remote cameras (yielding two dimensional views), or the use of potentially leaky transparent panels embedded or affixed to the canoe and kayak hull and supporting structure, or alternatively, the use of a folding kayaks with flexible hulls encompassing a transparent plastic film subject to optical distortion, tearing, and sunlight degradation.

One prior solution to transparent kayak hulls result in the hull of the boat being a flexible film material as is the case in U.S. Pat. No. 4,841,899. The extreme flexibility of the material described therein inherently distorts underwater views and renders the kayak useless without the means of internal supports. Additionally, the flexible, transparent materials described therein are easily cut and are subject to tearing if impacted on sharp objects such as coral, rock, or shell. Lastly the use of film material requires an internal supporting structure for the canoe or kayak.

The prior art for glass bottom or transparent kayaks and canoes is extremely limited, thus consideration of all prior art relating to "glass bottom boats", canoes and kayaks, as well as vessel hull construction was made. Subsequently, a number of "glass bottom boats" were found, however, none of which were suitable for kayaks and only one having a unitarily constructed hull: it was for a recreational, outboard motor powered craft.

In general, there are multiple attempts to solve the problem of underwater visibility through panels placed in the hull of a boat. While this method does solve the problem of underwater visibility in a human powered craft, it is not seamless and provides the opportunity for water to permeate the abutments of the hull panels. As is the case with kayaks, lateral and longitudinal stress and flexing provide the opportunity for water intrusion when abutments of panels are placed at or below the waterline.

Having a rigid framework within a plastic hull is one of many solutions previously sought for glass bottom boats. However, rigid frames do not provide for the necessary flexing of a kayak hull, and in the case of aluminum frames a severe impact could collapse the frame around the paddler thus entrapping the paddler. In the case of wood or other materials that could break in a severe impact, the paddler of the kayak could potentially be impaled.

U.S. Pat. No. 5,337,692 to Troiani addresses the problem of transparency as well as frameless design by forming a single transparent sheet of acrylic into a recreational boat hull with sponsons to stiffen the longitudinal axis of the hull as well as raise the transparent viewing plane above the surface of the water when not laden. This prior art states that the use of Lexan (a General Electric Company registered trademark for it's brand of polycarbonate) is unsuitable for any boat which is propelled by power means due to polycarbonates' sensitivity to acids and petroleum products. However, the use of acrylic as described by Troiani does not lend itself to canoes or kayaks due to its inability to withstand the severe shock and impacts encountered frequently by such craft. Additionally, canoes and kayaks are generally stored hull side up when not in use. Since acrylic is a combustible material and capable of solar magnification combustion especially when formed in parabolic shapes such as would be the case in a kayak hull it is not desirable for use as a kayak hull material.

The use of sponsons described in Troiani's patent do not adapt well to canoes or kayaks in so far as a canoe and kayak must be able to be rotated about a vertical axis very rapidly to enable the paddler to maneuver around rocks and other obstacles. Additionally, sponsons as described by Troiani only increase maneuverability at high speeds. Canoes and kayaks travel by paddle propulsion and thus are limited to slow speeds. Sponsons as described by Troiani would increase the depth of draw of the canoe or kayak thus decreasing maneuverability and improving its ability to become grounded in shallow water. Fleckless (U.S. Pat. No. 4,841,899) describes a transparent film skin on a frame-supported folding kayak. Rheney (U.S. Pat. No. 5,000,106) shows a wooden boat, not a canoe or kayak, with a skin of multiple polycarbonate plates. Reha (D341,565) shows the ornamental design for a transparent row boat. Troiani (U.S. Pat. No. 5,337,692) claims a unitarily formed transparent acrylic power boat invention with a sponson laden tunnel hull design clearly not related to a canoe or kayak, and of an unsuitable material for canoes and kayaks. Wortham (D343,380) shows the ornamental design for a transparent peddle boat, not related to canoes or kayaks. Dust (application 20010001941) describes a non-transparent boat that can be configured as either a canoe or kayak. Cochois (France FR2612447) describes a mold which can be split into two halves to form a canoe or kayak. Laplane (France FR2633892) describes a boat with a non-unitarily formed transparent polycarbonate plate; the boat is a dismantleable sailboat.

None of the references claim the use of unitarily formed transparent thermoplastic, specifically polycarbonate, in canoes or kayaks. No references found or cited claim the method, material, or design included in this applicants invention; specifically, a transparent unitarily formed canoe hull and a transparent unitarily formed kayak hull, both obtainable from the same molded thermoplastic sheet, and with a plurality of keels and chines in a configuration that increases stability, aids in tracking, aids in turning, and protects the viewing plane externally from abrasion and internally from collecting water.

The prior art for "glass bottom boats" is replete with various designs, but no single design addresses canoes or kayaks providing seamlessness, transparency, lightness, impact resistance, flexibility, ease of turning and straightness of tracking when paddled. Nor do the prior arts reveal the use of seamless, transparent thermoplastics in canoe or kayak hulls.

OBJECTS AND ADVANTAGES

It is a particular object of the invention to enhance the enjoyment of canoes and kayaks by providing optically clear transparent hulls.

Further objects and advantages of the present invention are:

(a) to provide a transparent canoe/kayak hull of sufficient lateral and longitudinal strength to require no internal supporting structure;

(b) to provide a transparent canoe/kayak hull with the flexibility and strength to withstand severe impacts;

(c) to provide a canoe/kayak hull made of self extinguishing material greatly reducing the chances of solar magnification combustion;

(d) to provide a transparent canoe/kayak hull with impact resistance greater than that of flexible film and acrylics;

(e) to provide a transparent canoe/kayak with a hull configuration that provides for ease of spinning and straight tracking when paddled;

(f) to provide a transparent canoe/kayak hull that may be decorated, labeled, painted, or imprinted from inside or outside yet allow such adornments to be visible from the opposite side;

(g) to provide a transparent canoe/kayak hull to which a plurality of caps and decks may be affixed during the assembly process.

Further objects and advantages are to provide a transparent canoe/kayak hull that is stable to paddle, inexpensive to manufacture, light in weight, and allows for variations in top cap designs without alteration of the mold from which the hull of the canoe or kayak was formed. Still further objects and advantages will become apparent from a consideration of the ensuing description and drawings.

SUMMARY

In accordance with the present invention a transparent canoe/kayak hull comprises a seamless transparent hull unitarily formed from a single sheet of transparent thermoplastic with the interior surface of the hull elevated amidships to allow water from paddle drips to run into interior channels which also serve as hull centerline chines for ease of tracking and turning as well as to protect the viewing surface of hull from exterior abrasion.

DRAWINGS

The above and other embodiments of the present invention may be more fully understood from the following detailed description, taken together with the accompanying drawings, wherein similar reference characters refer to similar elements throughout, and in which.

DETAILED DESCRIPTION OF PREFERRED EMBODIMENTS

Figure 1:
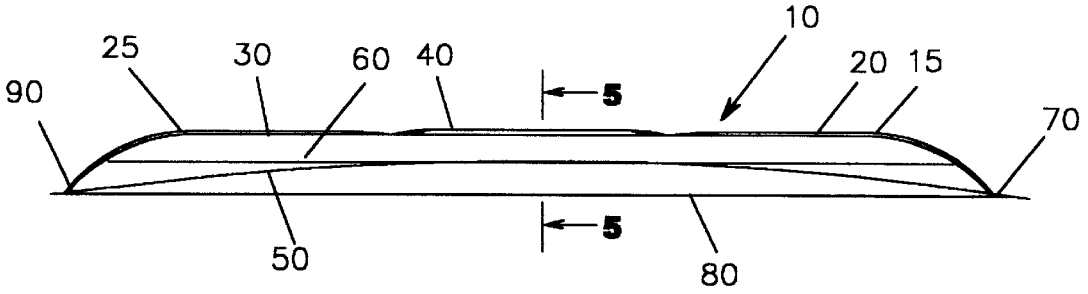
FIG. 1 is a side view of the preferred embodiment in an untrimmed state as removed from the mold.

Referring now to the drawings, FIG. 1 shows the preferred embodiment of the canoe/kayak hull fabricated according to the invention in it's untrimmed state as formed.

The hull 10 may be unitarily formed from transparent thermoplastic sheet via vacuum forming heated, transparent thermoplastic sheet stock to a temperature controlled mold of a preselected shape. In the preferred embodiment, the material is clear polycarbonate. The configuration of the hull 10 in the preferred embodiment incorporates a forward keel 20, an aft keel 30, a plurality of chines 40, a canoe trim line 50, and a kayak trim line 60. The forward keel 20 arises from the arc of the bow where the bow radius ends at horizontal 15. The forward keel 20 is a semicircular configuration and ends at a point of perpendicular intersection with the front of the outboard chines 40. Likewise, the aft keel 30 arises from the arc of the stern where said arc ends at horizontal 25 and the aft keel ends at a point of intersection with the rear of the outboard chines 40. The aft keel 30, as in the forward keel 20 is a semicircular configuration.

The canoe and kayak trim lines, 50 and 60, respectively, are cast into the mold as raised ribs in the case of male molds, and are cast as indentions in the case of female molds. The ribs forming the trim lines are radiused and angled such as not to create an undercut that would prevent the thermoformed sheet from being extracted from the mold.

Figure 2:
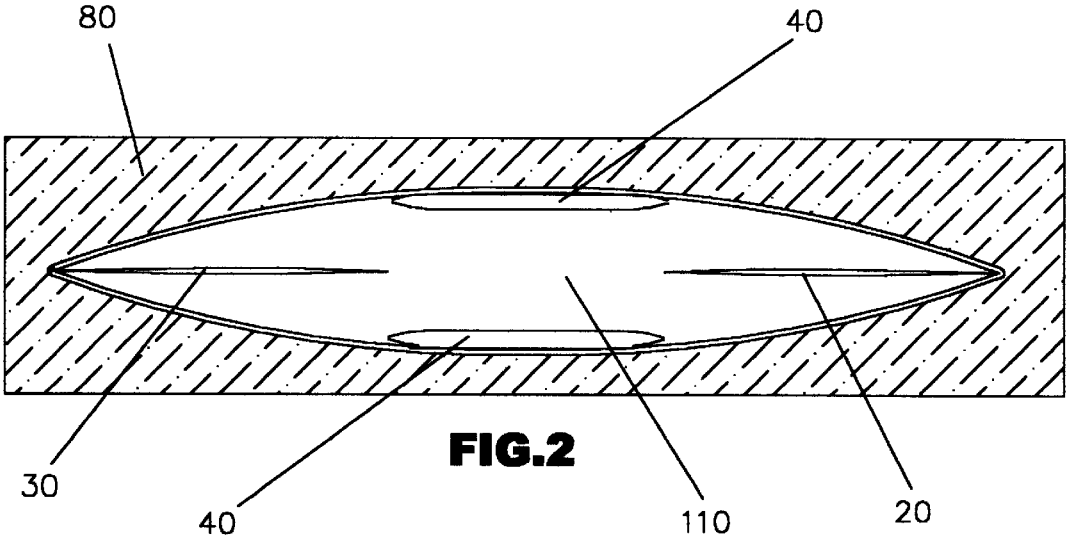
FIG. 2 is a top elevation view of the preferred embodiment in an untrimmed state showing the arrangement of keels and chines, and viewing plane as removed from the mold.

Referring now to FIG. 2, the chines 40 are formed parallel to the keels 20 and 30. The chines 40 are formed along the lower edge of the hull and begin amidship and end forward at a point of lateral intersection with the bow keel 20 and end in the rear at a point of lateral intersection with the stern keel 30. The area surrounded by the chines 40, the forward keel 20, and the aft keel 30 is the viewing plane 110. The viewing plane 110 is amidship; in the center of the hull bottom. The chines 40 are compound radiuses to follow the lines of the hull sides as well as to form an inboard channel. The viewing plane 110 is relatively flat so as not to distort underwater views. The viewing plane 110 is protected fore and aft by raised keels 20 and 30 respectively. The viewing plane is protected laterally by chines 40 which also act as interior channels which retain water from paddle drips. The hull flashing 80 is removed during the trimming process via a saw or router, either manual, or CNC controlled. The point of removal is determined via the nature of the craft being trimmed. If the hull is to be used in the production of a kayak, it is trimmed along the kayak trim line 60 as shown in FIG. 1. If the hull is to be used in the production of a canoe, it is trimmed along the canoe trim line 50 as shown in FIG. 1. Note that the kayak trim line 60 and the canoe trim line 50 intersect amidship. The kayak trim line is horizontal to the hull viewing plane 110 as shown in FIG. 2, however the canoe trim line 50 is an arc whose lowest point is amidship and terminates at the bow and stern where the molded portion of the hull 10, intersects the hull flashing. The hull flashing 80 is a by product of the vacuum forming process created by the flanges of the molds necessary to seal the heated sheet to the mold prior to air evacuation.

Figure 3:
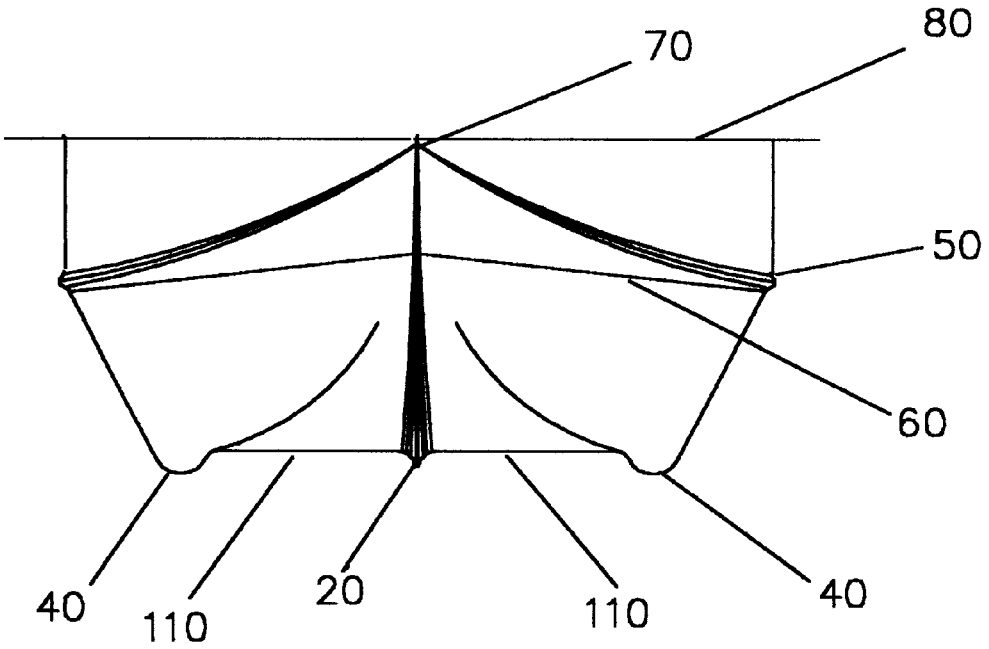
FIG. 3 is a front view of the hull in an untrimmed state.

FIG. 3 is front elevation view of the untrimmed hull 10 in an upright attitude. The outboard vertical shape of the chines 40 are a continuation of the hull sides. The inboard shape of the chines 40 are a radius of 0.75 to 2.00 inches and vary depending upon the size of the canoe/kayak hull being formed. The angle of intersection of the chines 40 and the viewing plane 110 is dependent upon the radius of the chines 40. The chines 40 serve to add structural integrity to the hull, provide a recess for channeling away inside spray and paddle drips from the viewing plane, and to aid in protecting the viewing plane from outside abrasion. The canoe trim line 50 runs the perimeter of the hull beginning at the forepeak of the bow 70 of the formed hull approximately 1 inch below the hull flashing 80 continuing down each side in an arc to a point approximately amidships where said arc reaches an apex. The canoe trim line continues from the arc apex to a point of intersection with the forepeak of the hull stern 90 as shown in FIG. 1, at a height of approximately 1 inch below the hull flashing 80.

The canoe trim line 50, shown in FIG. 3, is the widest section of the hull at any point along the length of the hull when measured perpendicular to the hulls bow-stern plane. The canoe trim line 50, is formed into the hull to facilitate trimming the hull in a configuration suitable for a canoe whereby the bow and stern are the greatest depths of the hull, and amidships is the shallowest depth. The hull sides above the canoe trim line 50 intersects the hull flashing 80 at an angle of 90 degrees to facilitate installation of gunnels during canoe assembly.

Figure 4:
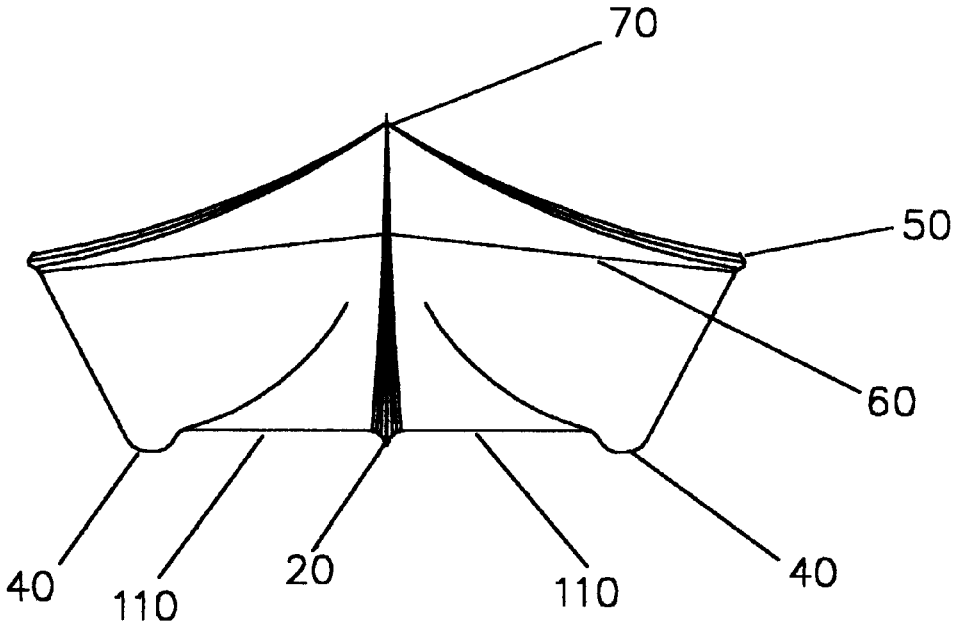
FIG. 4 is a front view of the hull trimmed as a canoe.

FIG. 4 shows the hull trimmed as a canoe. The hull flashing, 80 as shown in FIG. 3 has been removed via trimming along the canoe trim line 50. The kayak trim line 60 is still present and acts as a lateral stiffener and small spray rail running the circumference of the hull.

Figure 5:
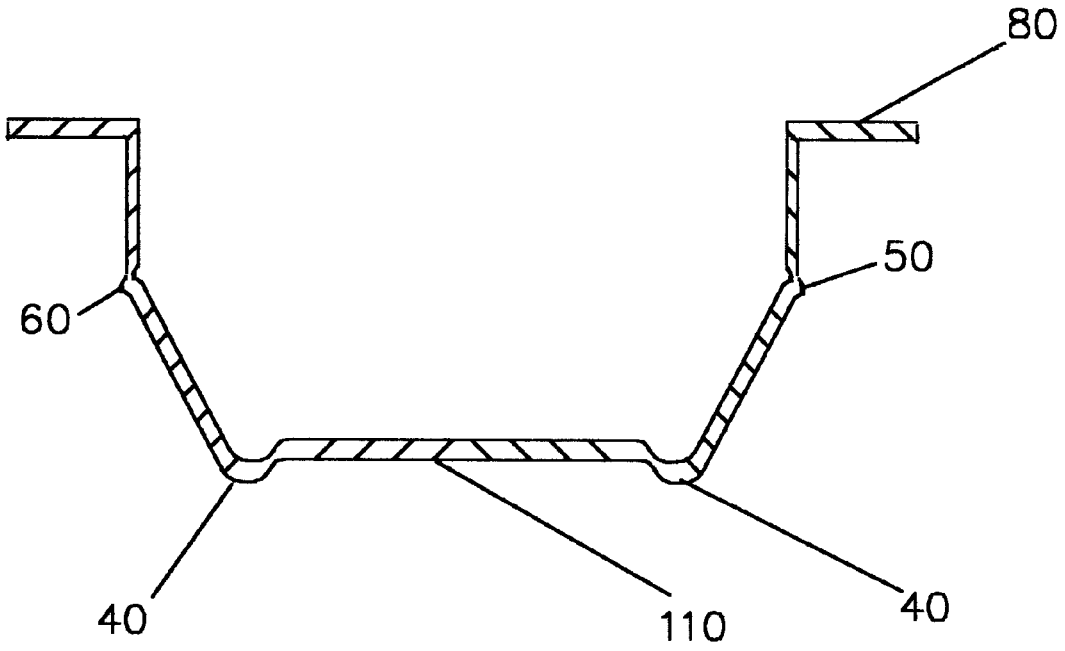
FIG. 5 is a midship cross section of the untrimmed hull

Referring to FIG. 5, the canoe trim line 50 is formed as a raised step in the hull side 10. The canoe trim line 50 aids in the longitudinal strength of the canoe, adds lateral stiffness to the hull sides, and serves as a guide for properly trimming the canoe hull from the molded transparent thermoplastic sheet. The kayak trim line 60 shown also in FIGS. 3, 4, 5 and 6, is the second widest section of the hull at any point along the length of the hull when measured perpendicular to the hulls bow-stern plane. The kayak trim line 60, is formed into the hull to facilitate trimming the hull in a configuration suitable for a kayak whereby the bow and stern are relatively parallel to the viewing plane 110. The kayak trim line 60 is formed as a step on the hull side, just below the canoe trim line when viewed in it's operational plane. The kayak trim line 60 is formed on a horizontal plane parallel to the hull flashing 80 and encircles the perimeter of the hull at a height of approximately one-half the untrimmed hull formation.

Figure 6:
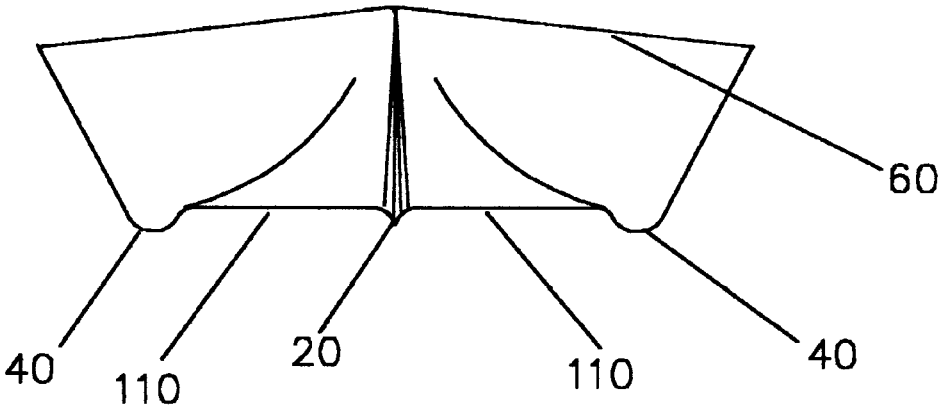
FIG. 6 is a front view of the hull trimmed as a kayak.

FIG. 6 is a front view of a hull 10 trimmed as a kayak. The hull flashing, 80 as shown in FIG. 3 has as well as the portion of the hull from the canoe trim line 50, to the hull flashing 80 as shown in FIG. 1, 3 and FIG. 5 have been removed during trimming along the kayak trim line 60.

Figure 7:
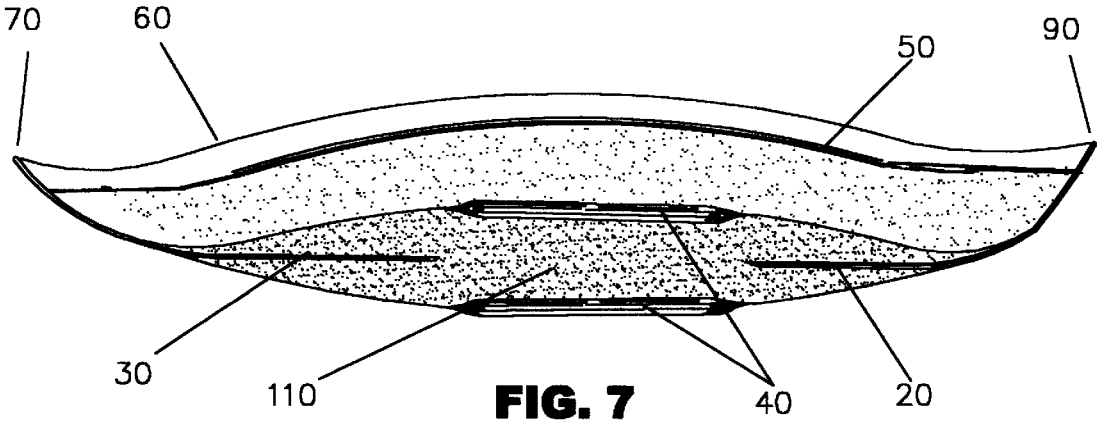
FIG. 7 is a perspective view of the hull trimmed as a canoe.

FIG. 7, is a side elevation view of an unassembled hull trimmed of flashing at the canoe trim line 50.

Figure 8:
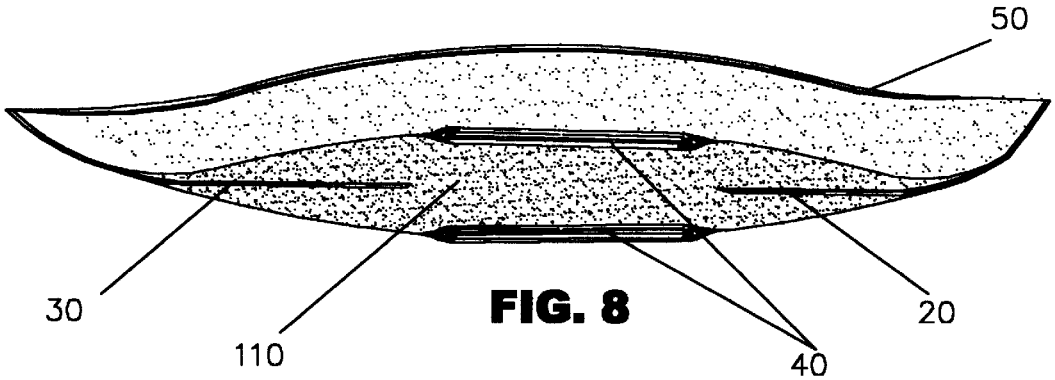
FIG. 8 is a perspective view of the hull trimmed as a kayak.

FIG. 8, is a side elevation view of a hull 10 trimmed on the kayak trim line 60.

Since certain changes may be made in the above apparatus without departing from the scope of the invention herein involved, it is intended that all matter, including dimension and angles, contained in the above description, as shown in the accompanying drawings, shall be interpreted in an illustrative, and not a limiting sense.

I claim:

1. A self supporting unitarily formed transparent polycarbonate boat hull of a canoe or kayak comprising, in combination: a plurality of chines extending in a fore and aft direction from the outboard midpoint lower hull edge where said chines end at a point of lateral intersection with fore and aft keels which extend from the bow and stern toward one another terminating at a point of lateral intersection with said chine ends; a centrally located viewing plane protected externally, fore and aft and laterally by said keels and chines.

* * * * *